US006326944B1

(12) United States Patent
MacLean et al.

(10) Patent No.: US 6,326,944 B1
(45) Date of Patent: Dec. 4, 2001

(54) COLOR IMAGE DEVICE WITH INTEGRAL HEATERS

(75) Inventors: Steven D. MacLean, Webster; Xin Wen, Rochester; William H. Simpson, Pittsford, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/075,081

(22) Filed: May 8, 1998

(51) Int. Cl.[7] ..... G09G 3/34

(52) U.S. Cl. ..... 345/106; 345/107; 345/108; 347/112

(58) Field of Search ..... 345/106, 107, 345/108; 347/112

(56) References Cited

U.S. PATENT DOCUMENTS

| | | | | |
|---|---|---|---|---|
| 3,612,758 | | 10/1971 | Evans et al. | 345/106 |
| 4,113,482 | * | 9/1978 | Wells | 345/108 |
| 4,143,103 | | 3/1979 | Sheridon | 345/106 |
| 4,298,448 | * | 11/1981 | Muller et al. | 345/107 |
| 5,344,594 | | 9/1994 | Sheridon | 345/107 |
| 5,604,027 | | 2/1997 | Sheridon | 345/107 |
| 5,854,614 | * | 12/1998 | Larson | 345/106 |
| 6,064,413 | * | 5/2000 | Wen et al. | 345/107 |
| 6,081,285 | * | 5/2000 | Wen et al. | 345/107 |
| 6,177,947 | * | 1/2001 | Wen et al. | 347/112 |

OTHER PUBLICATIONS

"A Newly Developed Electrical Twisting Ball Display" by Saitoh et al p249–253, Proceedings of the SID, vol. 23/4, 1982.

* cited by examiner

*Primary Examiner*—Richard Hjerpe
*Assistant Examiner*—Ali A. Zamani
(74) *Attorney, Agent, or Firm*—Raymond L. Owens

(57) ABSTRACT

A display includes a substrate, a matrix formed over the substrate, and thermomeltable material disposed in the matrix, having a transition temperature range above room temperature wherein the viscosity of the thermomeltable material decreases substantially from below to above the transition temperature range. The display also includes field-driven particles, immersed in the thermomeltable material, so that the field-driven particles change reflective densities in response to an applied electric field when the material is above the transition temperature range and is stable at temperatures below its transition temperature range, and heater(s) disposed in the display associated with the matrix for controlling the temperature of at least a portion of the matrix to control the response of the field-driven particles in the matrix.

16 Claims, 5 Drawing Sheets

COLOR IMAGE DEVICE WITH INTEGRAL HEATERS

CROSS REFERENCE TO RELATED APPLICATIONS

Reference is made to commonly assigned U.S. patent application Ser. No. 09/012,842 filed Jan. 23, 1998, entitled "Addressing Non-Emissive Color Display Device" to Wen et al; U.S. patent application Ser. No. 09/035,516 filed Mar. 5, 1998, entitled "Heat Assisted Image Formation in Receivers Having Field-Driven Particles" to Wen et al; U.S. patent application Ser. No. 09/034,066 filed Mar. 3, 1998, entitled "Printing Continuous Tone Images on Receivers Having Field-Driven Particles" to Wen et al; U.S. patent application Ser. No. 09/037,229 filed Mar. 10, 1998, entitled "Calibrating Pixels in a Non-emissive Display Device" to Wen et al; U.S. patent application Ser. No. 09/054,092 filed Apr. 2, 1998, entitled "Color Image Formation In Receivers Having Field-Driven Particles" to Wen et al. The disclosure of these related application is incorporated herein by reference.

FIELD OF THE INVENTION

This invention relates to an image display having field-driven particles.

BACKGROUND OF THE INVENTION

There are several types of field-driven particles in the field of non-emissive displays. One class uses the so-called electrophoretic particle that is based on the principle of movement of charged colloidal particles in an electric field. In an electrophoretic display, the charged particles containing different reflective optical densities can be moved by an electric field to or away from the viewing side of the display, which produces a contrast in the optical density. Another class of field-driven particles are particles carrying an electric dipole. Each pole of the particle is associated with a different optical densities (bi-chromatic). The electric dipole can be aligned by a pair of electrodes in two directions, which orient each of the two polar surfaces to the viewing direction. The different optical densities on the two halves of the particles thus produces a contrast in the optical densities.

To produce a high quality image, it is essential to form a plurality of image pixels by varying the electric field on a pixel wise basis. The electric fields can be produced by a plurality pairs of electrodes embodied in the display as disclosed in U.S. Pat. No. 3,612,758. One difficulty is in displaying color images. The field-driven particles of different colors need to be provided in discrete color pixels. This approach requires the colored particles to be placed in precise registration corresponding to the electrodes. This approach is therefore complex and expensive.

An additional problem in the displays comprising field-driven particles is forming images that are stable. Typically the images on these displays must be periodically refreshed to keep the image from degrading.

Small size is a highly desirable feature in a product or subsystem. High levels of integration tend to reduce system size and cost. It is desirable to improve the integration of display devices. System complexity is reduced by integration; the integration of a display will allow the display to be operated with fewer auxiliary devices.

SUMMARY OF THE INVENTION

It is an object of the present invention to provide a compact display which produces highly stable images in response to temperature changes.

This objects are achieved by a display comprising:

a) a substrate;

b) a matrix formed over the substrate;

c) thermomeltable material disposed in the matrix, having a transition temperature range above room temperature wherein the viscosity of the thermomeltable material decreases substantially from below to above the transition temperature range;

d) field-driven particles, immersed in the thermomeltable material, so that the field-driven particles change reflective densities in response to an applied electric field when the material is above the transition temperature range and is stable at temperatures below its transition temperature range;

e) an array electrodes disposed above the substrate forming pairs of electrodes with each pair intersecting at a pixel for selectively applying an electric field in opposite directions across the matrix to drive the field-driven particles; and f) heating means disposed in the display associated with the matrix for controlling the temperature of at least a portion of the matrix to control the response of the field-driven particles in the matrix.

ADVANTAGES

An advantage of the present invention is that the heater(s) are associated with the matrix and can be addressed to cooperatively produce monochrome or colored images in the display.

By providing heater(s) associated with the matrix; the display can be made compact; the power consumption is reduced by directly heating the matrix; and highly stable images are formed.

An advantage of the present invention is that the colored field-driven particles can be provided in a display without forming spatially discrete color pixels.

A further feature is to provide a display having field-driven particles which is highly stable at room temperature.

An additional advantage is that the image formed by the color field-driven particles on a display are stabilized by a viscous material below melting temperature when the image is displayed.

DETAILED DESCRIPTION OF THE INVENTION

Figure 1:
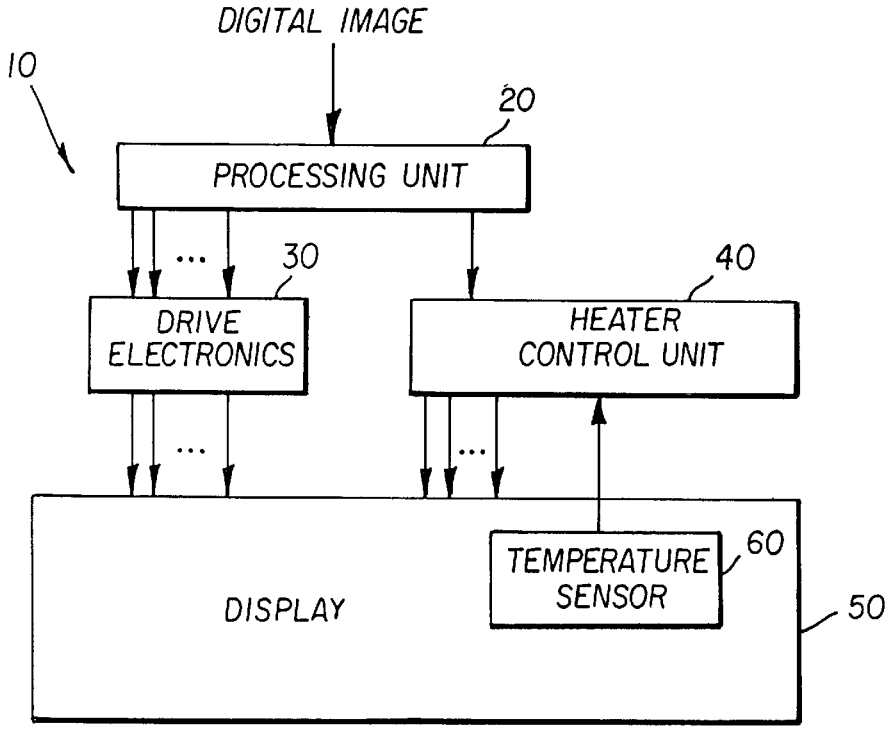
FIG. 1 shows an electronic display apparatus in accordance to the present invention.

FIG. 1 shows the electronic display apparatus 10 in accordance to the present invention. The electronic display apparatus 10 includes a processing unit 20, a drive electronics 30, a heater control unit 40, and a display 50 comprised of field-driven particles in a matrix (see FIG. 3). The display 50 is shown to include a temperature sensor 60. A digital image is shown to be presented to the processing unit 20. The processing unit 20 is shown to control the drive electronics 30 and the heater control unit 40. The temperature sensor 60 detects the temperature of the display and sends electrical signals corresponding to the temperature to the heater control unit 40. The heater control unit 40 regulates the temperature of the display 50. The drive electronics 30 provide the electrical signals required to write the image. Thus, the processing unit controls 20 forms the digital image on the display 50. The image forming process will be discussed in detail below.

Figure 2:
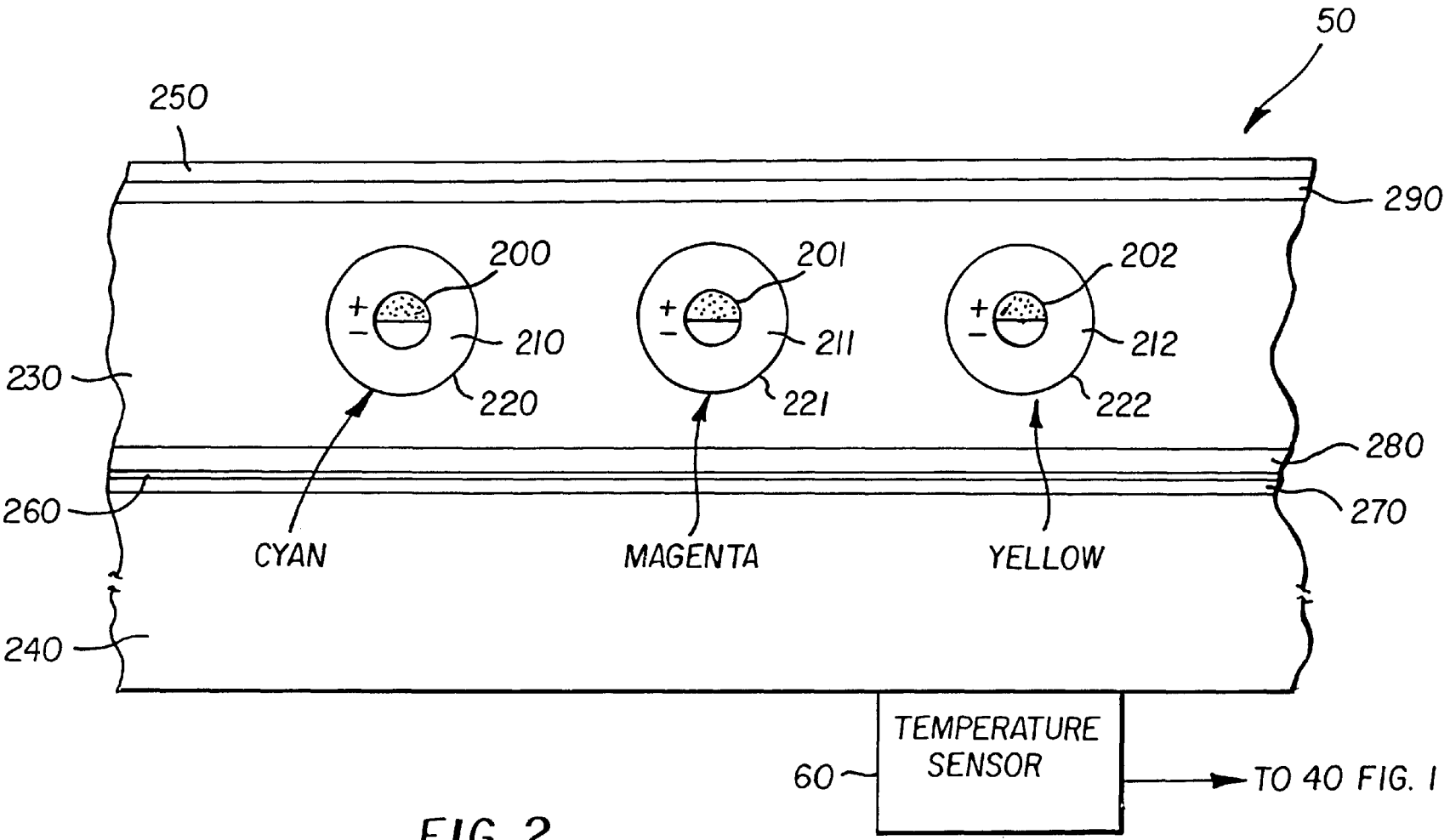
FIG. 2 shows a cross section of the display of FIG. 1 and depicting the colored field-driven particles.

FIG. 2 shows a cross sectional view of a portion of the display 50 of FIG. 1. The cross section shows a small portion of a display element (pixel). The display 50 is comprised of a substrate 240, a heater 270 disposed on the substrate 240, a passivation layer 260 is disposed above the heater 270, an array of bottom electrodes 280 disposed above the passivation layer 260, a matrix 230 disposed above the array of bottom electrodes 280, an array of top electrodes 290 disposed above the matrix 230, and a protective top coat 250 disposed over the matrix the array of top electrodes 290. The array of top electrodes 290 are formed of transparent conducting materials such as indium tin oxide for the viewing of the image formed in the matrix. The temperature sensor 60 of FIG. 1 is shown to be attached to the substrate to monitor the temperature of the display 50. The temperature sensor 60 is connected to the heater control unit 40 of FIG. 1.

The substrate 240 controls the flexibility and durability of the display 50. The substrate 240 can be a polymer layer. In some applications, rigid substrate such as glass and ceramics can also be used. The heater 270 will be discussed below. The passivation layer 260 is provided to electrically isolate the bottom electrodes 280 from the heater 270. The arrays of electrodes 280 and 290 are arranged in a grid pattern. Each pair of electrodes intersect at a point corresponding to a pixel. The array of electrodes are connected to the drive electronics 30 of FIG. 1. An electric voltage is applied by drive electronics 30 across the pair of electrodes at each pixel location to produce the desired optical density at that pixel. A protective top coat 250 is disposed above the array of top electrodes 290 to protect the display 50 and to provide a surface treatment (matte or gloss). Details of the addressing circuitry for the electrodes are disclosed in commonly assigned U.S. patent application Ser. No. 09/034,066 filed Mar. 3, 1998, entitled "Printing Continuous Tone Images on Receivers Having Field-Driven Particles" to Wen et al.

The heater 270 is connected to the heater control unit 40 of FIG. 1. The heater 270 consists of an array of heater elements. Each heater element corresponds to a row in the display 50. The heater 270 could alternately be segmented without substantially changing the present invention. For example, an array of heaters could be formed to correspond to individual pixels, single columns, multiple columns, single rows, multiple rows, individual pixels, and other regions. The heater 270 is embodied by an array of carbon film resistors. The heaters may also be formed of a diode junction or any material which resistively consumes electrical power (creating heat). Each member of the heater 270 is electrically isolated. Since the heater 270 is adjacent to the matrix 230, only a portion of the display needs to be heated to cause a change in temperature in the thermomeltable materials 210–212 (discussed below). Additionally the heater is in direct contact with the display providing improved thermal conductivity to the. These two factors each allow the energy requirements for the display to be substantially reduced.

The matrix 230 is shown to include a plurality of field-driven particles, cyan field-driven particles 200, magenta field-driven particles 201, and yellow field-driven particles 202. The field-driven particles are exemplified by bi-chromatic particles, that is, half of the particle is white and the other half is of a different color density such as black, yellow, magenta, cyan, red, green, blue, etc. The cyan field-driven particles 200 are half cyan and half white. The magenta field-driven particles 201 are half magenta and half white. The yellow field driven particles 202 are half yellow and half white. The bi-chromatic particles are electrically bi-polar. Each of the color surfaces (e.g. white and black) is aligned with one pole of the dipole direction. It will be understood that the field-driven particles 200–202 may vary in characteristics such as particle size, particle density, or particle charge without substantially modifying the present invention. The stable field-driven particles 200–202 are immersed in a thermomeltable materials 210–212 which are together encapsulated in respective microcapsule 220–222. The cyan field-driven particles 200 are immersed in a thermomeltable material for cyan field-driven particles 210 and together encapsulated in a microcapsule for cyan field-driven particles 220. The magenta field-driven particles 201 are immersed in a thermomeltable material for magenta field-driven particles 211 and together encapsulated in a microcapsule for magenta field-driven particles 221. The yellow field-driven particles 202 are immersed in a thermomeltable material for yellow field-driven particles 212 and together encapsulated in a microcapsule for yellow field-driven particles 222.

The term thermomeltable material will be understood to mean a material which substantially decreases its viscosity when its' temperature is raised from below to above a transition temperature (range). The transition temperature range typically corresponds to a transition in chemical phase or physical configuration. Examples of the transition include melting (and freezing), solidifying, hardening, glass transition, chemical or physical polymerization, cross-linking or gelation, aggregation or association of particles or molecules. When the temperature of the thermomeltable material is varied from above to below the transition temperature, the viscosity typically increases at least a factor of five, and preferably ten times or larger. The mobility of the field-driven particles is inversely related to the viscosity of the thermomeltable material where in the field-driven particles are immersed. The materials for the thermomeltable materials are each different having different transition temperature ranges and are discussed below. The microcapsules are immersed in a matrix 230 which is in the form of a deposited layer. The preferred embodiment permits the microcapsules to be randomly dispersed, however the microcapsules may also be formed in a regular pattern without affecting the present invention.

A substantial change in the viscosity of the thermomeltable material is defined by the effects on the field-driven particles. When immersed in such thermomeltable materials, the field-driven particles are immobile at temperatures below the transition temperature: that is, the field-driven particles do not change their physical configurations in the presence of an external (e.g. electric) field or thermodynamic agitation. At temperature above the transition temperature, the field-driven particles can respond (rotation or translation) to the external field to permit the change in color reflective densities. Typically, a thermometable material needs to changes viscosity a factor of five or larger through the transition.

An electric field induced in the microcapsules, when the thermometable material is in a low viscosity state, align the field-driven particles to a low energy direction in which the dipole opposes the electric field. When the field is removed the particles state remains unchanged. When the thermometable material is in a high viscosity state the field driven particles are unaffected by the electric field. FIG. 2 shows the cyan field-driven particle 200 in the cyan state as a result of field previously imposed, by a negative top electrode and positive bottom electrode (the electrode pair related to the pixel from the arrays of electrodes 280 and 290), during a low viscosity state of the thermometable material for cyan field-driven particles 210. If the polarity of the field had been reversed, during the low viscosity state of the thermometable material for cyan field-driven particles 210, the cyan field-driven particle 200 would be in the white state. FIG. 2 also shows the magenta field-driven particle 201 in the magenta state as a result of field previously imposed, by a negative top electrode and positive bottom electrode 90, during a low viscosity state of the thermometable material for magenta field-driven particles 211. If the polarity of the field had been reversed, during the low viscosity state of the thermometable material for magenta field-driven particles 211, the magenta field-driven particle 201 would be in the white state. FIG. 2 further shows the yellow field-driven particle 202 in the yellow state as a result of field previously imposed, by a negative top electrode of and positive bottom electrode 90, during a low viscosity state of the thermometable material for yellow field-driven particles 212. If the polarity of the field had been reversed, during the low viscosity state of the thermometable material for yellow field-driven particles 10 212, the yellow field-driven particle 202 would be in the white state. The present invention has been described as a three color device, it is understood that the invention could also be embodied in any number of colors without substantially modifying the invention. In particular the present invention could be used with a monochrome display thus providing the benefit of improved image stabilization. Since addressing or writing of different color planes are differentiated by elevated temperature, different color planes (yellow, magenta, cyan) can thus be written by the same array of electrodes 280 & 290. This simplifies the addressing electrodes. Furthermore the different colored microcapsules can be randomly distributed while electrodes are pixelated. This permits a single coating operation to uniformly coat all the color planes.

The field-driven particles can include many different types, for example, the bi-chromatic dipolar particles and electrophoretic particles. In this regard, the following disclosures are herein incorporated in the present invention. Details of the fabrication of the bi-chromatic dipolar particles and their addressing configuration are disclosed in U.S. Pat. Nos. 4,143,103; 5,344,594; and 5,604,027; and in "A Newly Developed Electrical Twisting Ball Display" by Saitoh et al p249–253, Proceedings of the SID, Vol. 23/4, 1982, the disclosure of these references are incorporated herein by reference. Another type of field-driven particle is disclosed in PCT Patent Application WO 97/04398. It is understood that the present invention is compatible with many other types of field-driven particles that can display different color densities under the influence of an electrically activated field.

As noted above the thermometable materials each have different transition temperature ranges. The thermometable materials are chosen to have transition temperature ranges which are different and do not overlap. The transition temperature range is preferably chosen to be well above room temperature to stabilize the image at room temperature. Examples of the thermometable materials and their transition temperatures are listed in Table I. The thermometable material for cyan field driven particles 210 is selected to be carnuba wax (corypha cerifera) which has a transition temperature range of 86–90° C. The thermometable material for magenta field driven particles 211 is selected to be beeswax (apis mellifera) which has a transition temperature range of 62–66° C. The thermometable material for yellow field driven particles 212 is selected to be myrtle wax (myria cerifera) which has a transition temperature range of 39–43° C. The thermometable materials are each waxes which solidify as the thermometable material temperature is decreased through the transition temperature range. Below the transition temperature range, the viscosity of the thermometable materials is substantially higher (solid) than at temperatures above the transition temperature range. Although waxes are used in the present invention other materials are equally compatible, provided they are selected to have differing transition temperature ranges. Several thermometable materials are shown in Table 1. It is understood that other thermometable materials may used in the present invention without substantially affecting the performance.

TABLE 1

| Thermometable Material | Transition temperature range(° C.) | Comment |
|---|---|---|
| Myrtle Wax | 39–43[1] | Myria Cerifera |
| Beeswax | 66–66[1] | Apis Melifera |
| Carnuba Wax | 86–90[1] | Corypha Cerifera |
| Eicosane $C_{20}H_{42}$ | 38[1] | |
| Triacontane $C_{30}H_{62}$ | 66.1[1] | |
| Pentatriacontane $C_{35}H_{72}$ | 74.7[1] | |
| Tetracosane $C_{24}H_{50}$ | 51.1[1] | |
| X-8040 Baker-Petrolite | 79[2] | Alpha olefin/maleic anhydride copolymer |
| Vybar 260 Baker-Petrolite | 54[2] | Ethylene derived hydrocarbon polymer |
| Vybar 103 Baker-Petrolite | 74[2] | Ethylene derived hydrocarbon polymer |

[1]Handbook of Chemistry and Physics, CRC Publishers, 42nd Edition, 1960–1961
[2]Technical Information, Baker-Petrolite, Tulsa, OK. 1998

Figure 3:
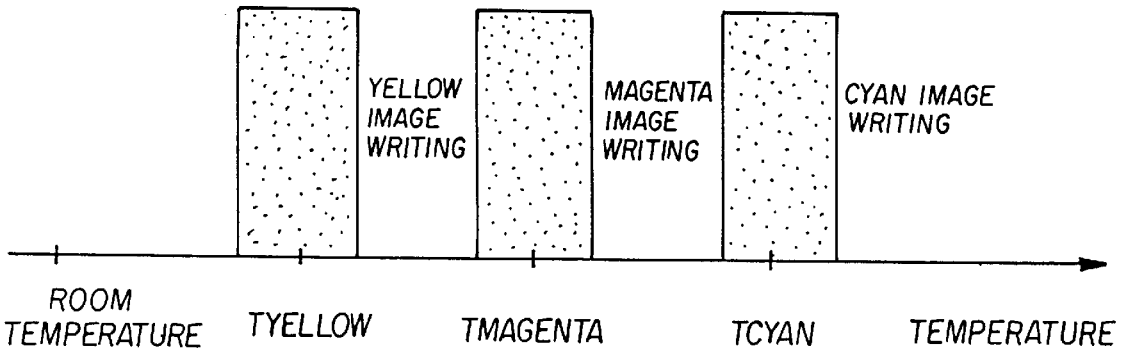
FIG. 3 is an illustration of the melting temperatures of the material in microcapsules and the temperature ranges for writing different color images.

FIG. 3 shows a plot of the exemplified transition temperature ranges of the thermometable materials (210–212) of display 50 (FIG. 3). In this example the thermometable material for cyan field-driven particles 210 is shown to have a transition temperature range $T_{cyan}$. The cyan plane is written at temperatures above this transition temperature range. The thermometable material for magenta field-driven particles 211 is shown to have a transition temperature range $T_{magenta}$. The magenta plane is written at temperatures above this transition temperature range and below the $T_{cyan}$ transition temperature range. The thermometable material for yellow field-driven particles 211 is shown to have a transition temperature range $T_{yellow}$. The yellow plane is written at temperatures above this transition temperature range and below the $T_{magenta}$ transition temperature range. The order of the transition temperature ranges can be changed with appropriate changes to the operating procedure.

Figure 4:
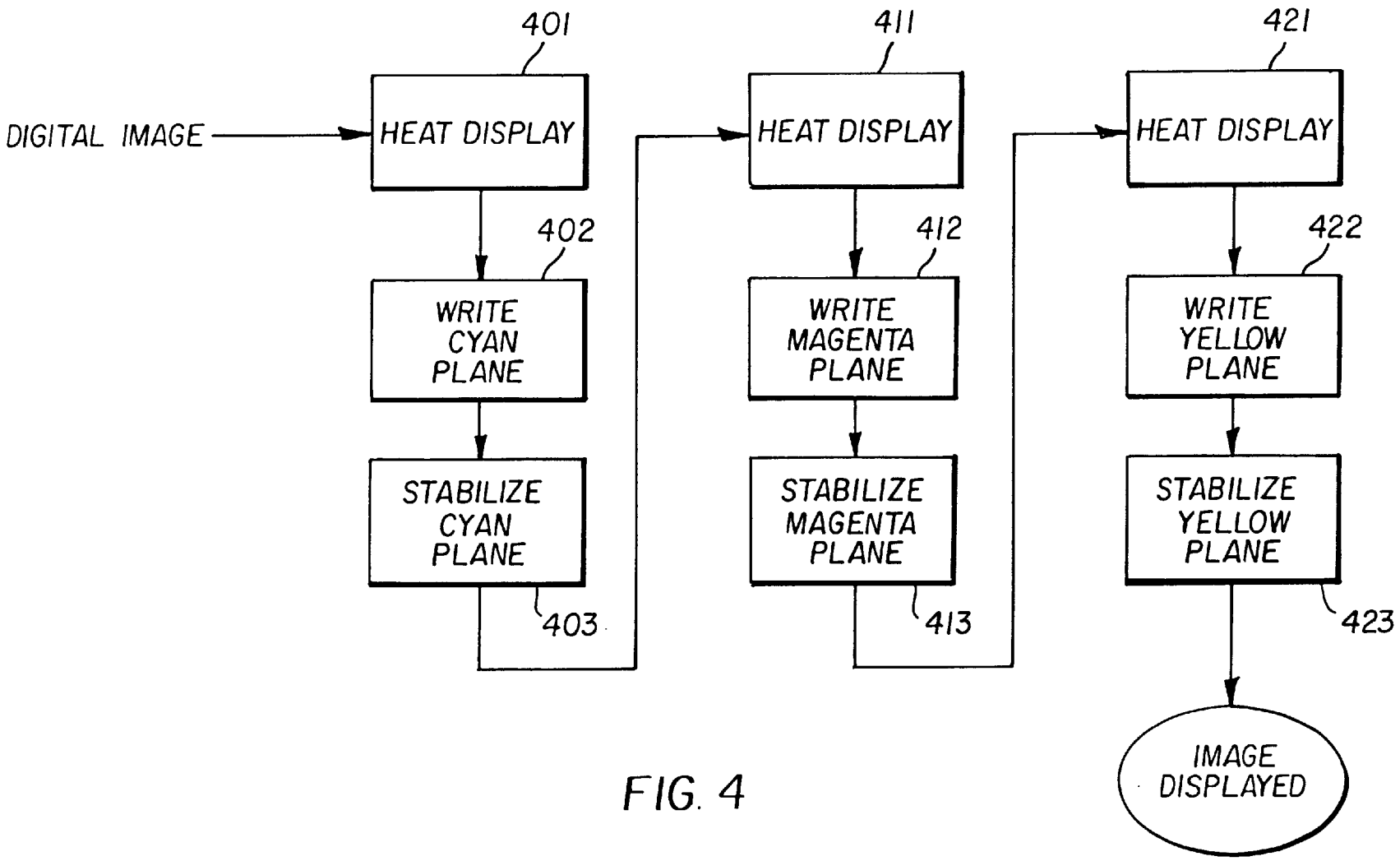
FIG. 4 schematically shows a flow diagram for producing color images on a display having color field-driven particles in accordance with the present invention.

Referring to FIG. 4, a typical operation of the electronic display apparatus 10 of FIG. 1 is described in the following. A digital image is presented to the processing unit 20 (FIG.

1). Processing unit 20 receives the digital image storing it in internal storage. All processes are controlled by processing unit 20 via drive electronics 30 (FIG. 1) and heater control unit 40 (FIG. 1). The processing unit 20, the drive electronics 30, and the heater control unit 40 will be collectively referred to as control electronics.

In a first operation heat display 401, the display 50 (FIG. 1) is heated by the heater 270 (FIG. 2) to a temperature above the transition temperature range for the thermomeltable material for cyan field driven particles 210 (FIG. 2). The amount of the heating power is controlled by heater control unit 40 (FIG. 1), using information from the temperature sensor 60 (FIG. 1). At this temperature the thermomeltable material for cyan field-driven particles 210 is in a low viscosity state.

After operation heat display 401, operation write cyan plane 402 is performed. Each pixel of the cyan plane is produced by an electric field applied by the corresponding pairs of the electrodes. The electrodes selected from the arrays of electrodes 280 and 290 (FIG. 1) and driven by the drive electronics 30. Each pixel location is driven according to the input digital image to produce the desired optical density as described in FIG. 2. The voltages are applied as a waveform, the first state of the waveform a positive voltage is applied to the top electrode causing the cyan field-driven particle 200 (FIG. 1) to a white state, erasing the cyan plane. In the second state of the waveform a negative voltage is applied to the top electrode for at a specific amplitude and duration, as determined by calibration data, causing a desired cyan optical density to be produced. For a more detailed description see commonly assigned U.S. patent application Ser. No. 09/034,066 filed Mar. 3, 1998, entitled "Printing Continuous Tone Images on Receivers Having Field-Driven Particles" to Wen et al. The field-driven particles for the other colors have been written with the cyan plane. This side effect will be eliminated by the erasure of these colors after the stabilization of the cyan plane.

After the operation write cyan plane 402, an operation stabilize cyan plane 403 is performed. This is accomplished by cooling the display below the transition temperature range for the thermomeltable material for cyan field-driven particles 210. At this temperature the thermomeltable material for cyan field-driven particles 210 is in a high viscosity state and the mobility of the cyan field-driven particles 200 is reduced, stabilizing the cyan plane on the display 50.

After the operation stabilize cyan plane 403, the operation heat display 411 is performed. The display 50 (FIG. 1) is heated by the heater 270 (FIG. 2) to a temperature above the transition temperature range for the thermomeltable material for magenta field driven particles 211 (FIG. 2) and below the transition temperature range for the thermomeltable material for cyan field driven particles 210 (FIG. 2). The amount of the heating power is controlled by heater control unit 40 (FIG. 1), using information from the temperature sensor 60 (FIG. 1). At this temperature the thermomeltable material for magenta field-driven particles 211 is in a low viscosity state.

After operation heat display 411, operation write magenta plane 412 is performed. Each pixel of the magenta plane is produced by an electric field applied by the corresponding pairs of the electrodes. The electrodes selected from the arrays of electrodes 280 and 290 (FIG. 1) and driven by the drive electronics 30. Each pixel location is driven according to the input digital image to produce the desired optical density as described in FIG. 2. The voltages are applied as a waveform, the first state of the waveform a positive voltage is applied to the top electrode causing the magenta field-driven particle 201 (FIG. 1) to a white state, erasing the magenta plane. In the second state of the waveform a negative voltage is applied to the top electrode for at a specific amplitude and duration, as determined by calibration data, causing a desired magenta optical density to be produced. For a more detailed description see commonly assigned U.S. patent application Ser. No. 09/034,066 filed Mar. 3, 1998, entitled "Printing Continuous Tone Images on Receivers Having Field-Driven Particles" to Wen et al. The field-driven particles for the yellow plane has been written with the magenta plane. This side effect will be eliminated by the erasure of the yellow plane colors after the stabilization of the magenta plane.

After the operation write magenta plane 412, an operation stabilize magenta plane 413 is performed. This is accomplished by cooling the display below the transition temperature range for the thermomeltable material for magenta field-driven particles 211. At this temperature the thermomeltable material for magenta field-driven particles 211 is in a high viscosity state and the mobility of the magenta field-driven particles 201 is reduced, stabilizing the magenta plane on the display 50.

After the operation stabilize magenta plane 413, the operation heat display 421 is performed. The display 50 (FIG. 1) is heated by the heater 270 (FIG. 2) to a temperature above the transition temperature range for the thermomeltable material for yellow field driven particles 212 (FIG. 2) and below the transition temperature range for the thermomeltable material for magenta field driven particles 212 (FIG. 2). The amount of the heating power is controlled by heater control unit 40 (FIG. 1), using information from the temperature sensor 60 (FIG. 1). At this temperature the thermomeltable material for yellow field-driven particles 211 is in a low viscosity state.

After operation heat display 421, operation write yellow plane 422 is performed. Each pixel of the magenta plane is produced by an electric field applied by the corresponding pairs of the electrodes. The electrodes selected from the arrays of electrodes 280 and 290 (FIG. 1) and driven by the drive electronics 30. Each pixel location is driven according to the input digital image to produce the desired optical density as described in FIG. 2. The voltages are applied as a waveform, the first state of the waveform a positive voltage is applied to the top electrode causing the yellow field-driven particle 202 (FIG. 1) to a white state, erasing the yellow plane. In the second state of the waveform a negative voltage is applied to the top electrode for at a specific amplitude and duration, as determined by calibration data, causing a desired yellow optical density to be produced. For a more detailed description see commonly assigned U.S. patent application Ser. No. 09/034,066 filed Mar. 3, 1998, entitled "Printing Continuous Tone Images on Receivers Having Field-Driven Particles" to Wen et al.

After the operation write yellow plane 422, an operation stabilize yellow plane 423 is performed. This is accomplished by cooling the display below the transition temperature range for the thermomeltable material for yellow field-driven particles 212. At this temperature the thermomeltable material for yellow field-driven particles 212 is in a high viscosity state and the mobility of the yellow field-driven particles 202 is reduced, stabilizing the yellow plane on the display 50. This complete the formation of the image. The image is now displayed.

Briefly reviewing the operation of the control electronics. The heater control unit 40 of FIG. 1 is coupled to the heater

270 of FIG. 2 for applying heat to control the temperature of the display 50 to selectively control the response of the field-driven particles 200–202 when an electric field is applied and coupled to the array of electrodes 280 and 290 for selectively applying voltages to the array of electrodes 280 and 290 so that electric fields are applied at particular locations on the display 50 corresponding to pixels in response to the stored image whereby the array of electrodes 280 and 290 produce the image in the display corresponding to the stored image.

Figure 5:
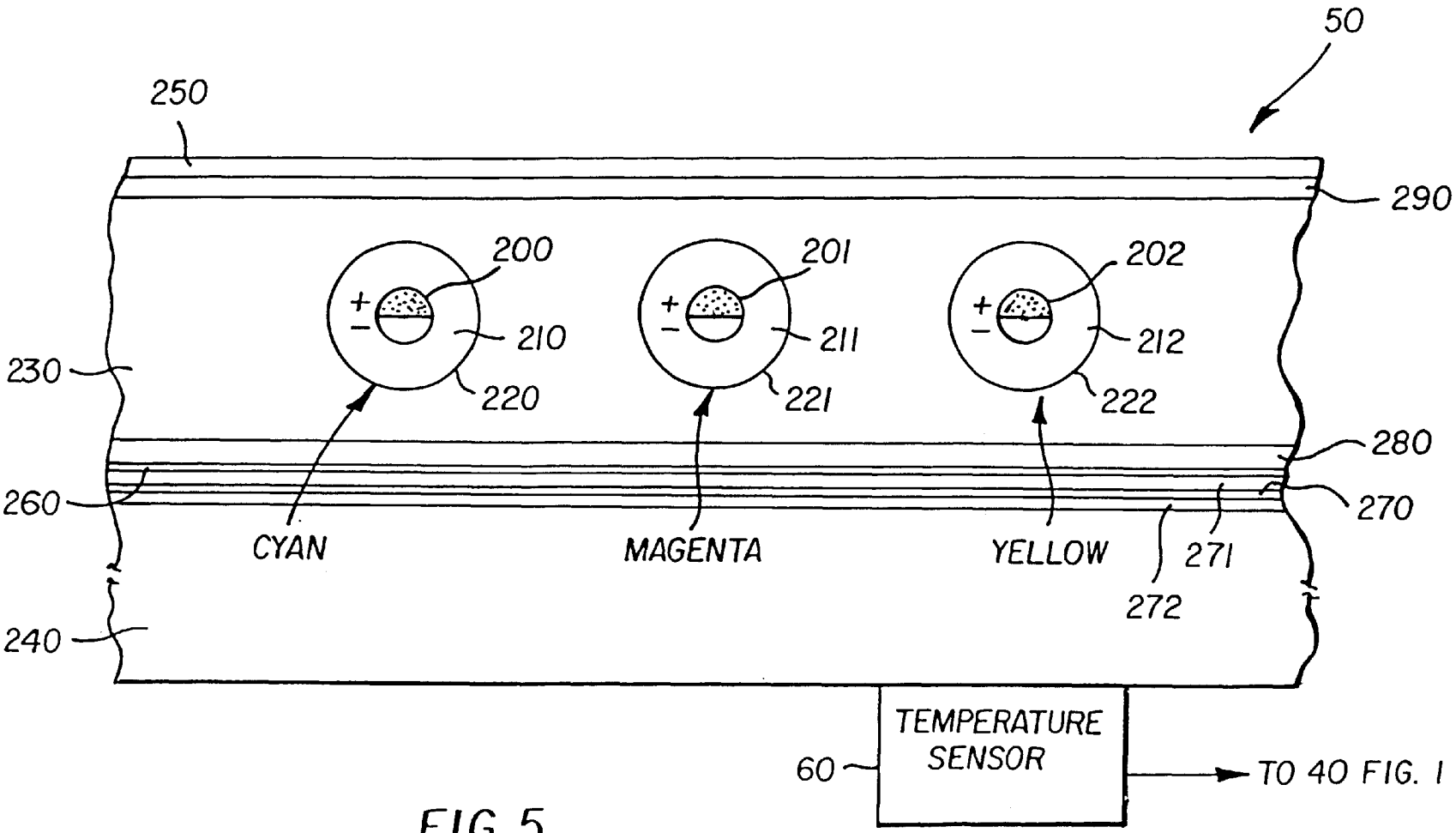
FIG. 5 shows a cross section of an alternate embodiment of the display of FIG. 1.

FIG. 5 shows a cross sectional view of a portion of an alternate embodiment of the display 50 of FIG. 1. The cross section shows a small portion of a display element (pixel). The display 50 is comprised of a substrate 240, a row array of electrodes 272, a heater 270 disposed above the substrate 240, a column array of electrodes 271, a passivation layer 260 disposed above the column array of electrodes 271, an array of bottom electrodes 280 disposed above the passivation layer 260, a matrix 230 disposed above the array of bottom electrodes 280, an array of top electrodes 290 disposed above the matrix 230, and a protective top coat 250 disposed over the matrix the array of top electrodes 290. The temperature sensor 60 of FIG. 1 is shown to be attached to the substrate to monitor the temperature of a the display 50. The temperature sensor 60 is connected to the heater control unit 40 of FIG. 1. The temperature sensor 60 is shown to monitor the local temperature of one portion of the display 50, this information is used to calibrate the entire display 50. Although only one temperature sensor 60 is shown it is understood multiple temperature sensors could be used to improve the calibration. The display 50 is identical to the display described with the exception of the heater 270, the column and row arrays of electrodes 271 and 272. The heater 270 is a resistive layer disposed between the column and row arrays of electrodes 271 and 272. The intersection of the column and row arrays of electrodes 271 and 272 form individually addressable resistive heater. The resistors provide heat as current is driven through them by the heater control unit 40 of FIG. 1. The number of rows and columns is chosen to provide the desired number of heating regions. The number of regions is selected to optimize power consumption and display cost.

Figure 6:
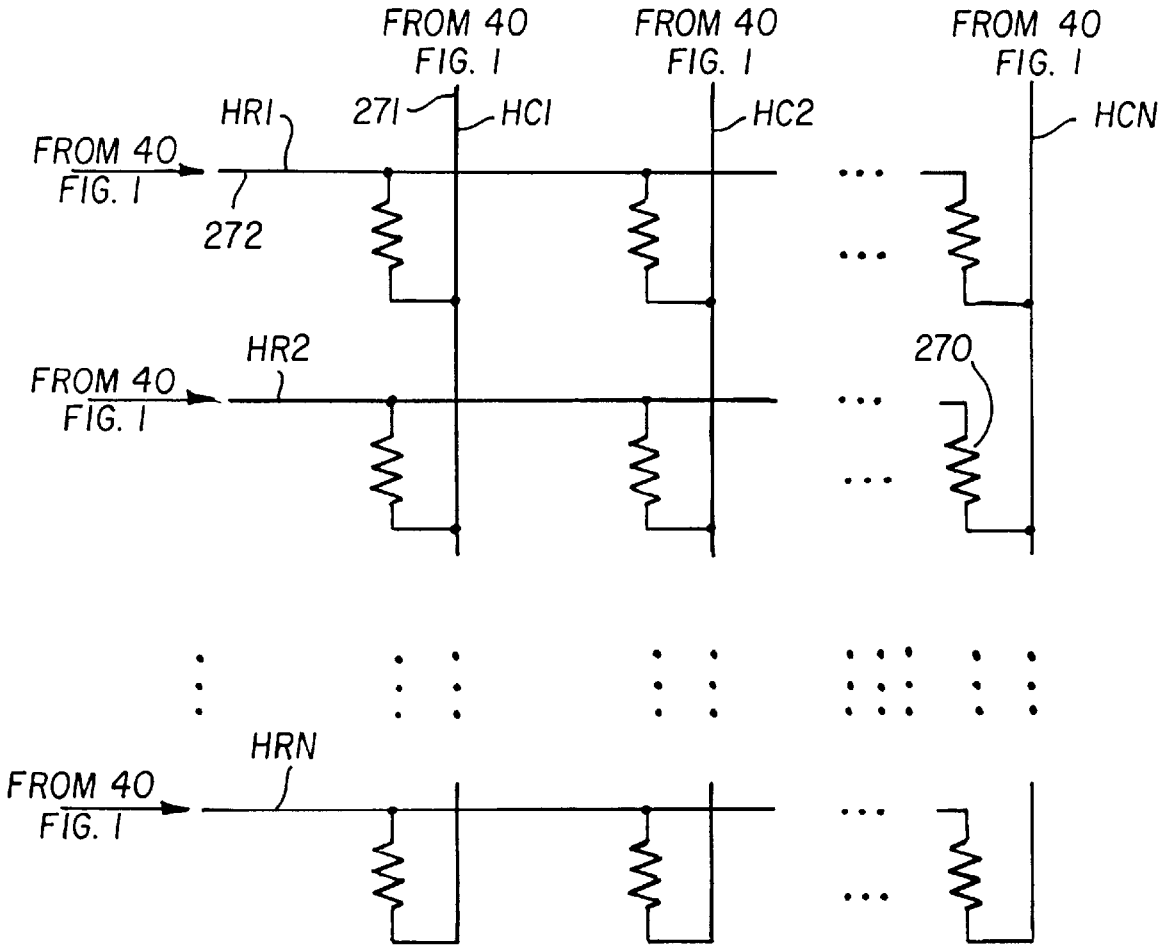
FIG. 6 shows a schematic for the heaters in the alternate embodiment in FIG. 5.

FIG. 6 shows an electric driving circuit for the heaters. In particular, the heater circuit in FIG. 6 corresponds the embodiment of segmented heaters, as described above. The heaters 270 are driven by the heater control unit 40 through the row array of electrodes 272 HR1, HR2, HR3 . . . HRM, and the column array of electrodes 271 HC1, HC2, HC3 . . . HCN. The heaters 270 can be used to heat one or more than one pixel areas. The heater can exist in many forms. For example, the heater can be a resistive layer as shown in FIG. 5 and as shown as a resistor symbol in FIG. 6. The heater can also be a diode. It is understood that many other circuitry designs can be used for driving and controlling the heaters.

The invention has been described in detail with particular reference to certain preferred embodiments thereof, but it will be understood that variations and modifications can be effected within the spirit and scope of the invention.

PARTS LIST

10 electronic display apparatus
20 processing unit
30 drive electronics
40 heater control unit
50 display
60 sensor
200 cyan field-driven particle
201 magenta field-driven particle
202 yellow field-driven particle
210 thermomeltable material for cyan field-driven particle
211 thermomeltable material for magenta field-driven particle
212 thermomeltable material for yellow field-driven particle
220 microcapsule for cyan field-driven particle
221 microcapsule for magenta field-driven particle
222 microcapsule for yellow field-driven particle
230 matrix
240 substrate
250 protective top coat
260 passivation layer
270 heater
271 column array of electrodes
272 row array of electrodes
280 array of bottom electrodes
290 array of top electrodes
401 heat display
402 write cyan plane
403 stabilize cyan plane
411 heat display
412 write magenta plane
413 stabilize magenta plane
421 heat display
422 write yellow plane
423 stabilize yellow plane

What is claimed is:

1. A display comprising:

a) a substrate;

b) a matrix formed over the substrate;

c) thermomeltable material disposed in the matrix, having a transition temperature range above room temperature wherein the viscosity of the thermomeltable material decreases substantially from below to above the transition temperature range;

d) field-driven particles, immersed in the thermomeltable material, so that the field-driven particles change reflective densities in response to an applied electric field when the material is above the transition temperature range and is stable at temperatures below its transition temperature range;

e) an array electrodes disposed above the substrate forming pairs of electrodes with each pair intersecting at a pixel for selectively applying an electric field in opposite directions across the matrix to drive the field-driven particles; and f) heating means disposed in the display associated with the matrix for controlling the temperature of at least a portion of the matrix to control the response of the field-driven particles in the matrix.

2. The display of claim 1 wherein the thermomeltable material is selected from the group consisting of wax, hydrocarbon polymers, or copolymers of alpha olefin and maleic anhydride.

3. The display of claim 1 wherein the field-driven particles include electrophoretic particles or dipolar bi-chromatic particles.

4. The display of claim 1 wherein the heating means includes a resistive layer for heating at least a portion of the matrix.

5. A color display comprising:

a) a substrate;

b) a matrix formed over the substrate;

c) at least two different thermomeltable materials disposed in the matrix, each having a transition temperature range above room temperature wherein the viscosity of the thermomeltable material decreases substantially from below to above the transition temperature range;

d) at least two different colored field-driven particles, each immersed in a particular one of the different thermomeltable materials, so that a particular color field-driven particle changes color reflective densities in response to an applied electric field when the material is above the transition temperature range and is stable at temperatures below its transition temperature range;

e) an array electrodes disposed above the substrate forming pairs of electrodes with each pair intersecting at a pixel for selectively applying an electric field in opposite directions across the matrix to drive the colored field-driven particles; and f) heating means disposed in the display associated with the matrix for controlling the temperature of at least a portion of the matrix to control the response of the colored field-driven particles in the matrix.

6. The display of claim 5 wherein the thermomeltable material is selected from the group consisting of wax, hydrocarbon polymers, or copolymers of alpha olefin and maleic anhydride.

7. The display of claim 5 wherein the field-driven particles include electrophoretic particles or dipolar bi-chromatic particles.

8. The display of claim 5 wherein the heating means includes a resistive layer for heating at least a portion of the matrix.

9. Apparatus for forming an image, comprising:

a) storage means for storing a digitized image;

b) a display comprising:

i) a substrate;

ii) a matrix formed over the substrate;

iii) thermomeltable material disposed in the matrix, having a transition temperature range above room temperature wherein the viscosity of the thermomeltable material decreases substantially from below to above the transition temperature range;

iv) field-driven particles, immersed in the thermomeltable material, so that the field-driven particles change reflective densities in response to an applied electric field when the material is above the transition temperature range and is stable at temperatures below its transition temperature range;

v) an array electrodes disposed above the substrate forming pairs of electrodes with each pair intersecting at a pixel for selectively applying an electric field in opposite directions across the matrix to drive the field-driven particles; and vi) heating means disposed in the display associated with the matrix for controlling the temperature of at least a portion of the matrix to control the response of the field-driven particles in the matrix; and c) electronic control means coupled to the heater means and the electrode array and responsive to the stored image for causing the heater means for selectively control the temperature of the matrix so that when the control means applies an electric field to the field-driven particles, they produce the image.

10. The apparatus of claim 9 wherein the thermomeltable material is selected from the group consisting of wax, hydrocarbon polymers, or copolymers of alpha olefin and maleic anhydride.

11. The apparatus of claim 9 wherein the field-driven particles include electrophoretic particles or dipolar bi-chromatic particles.

12. The apparatus of claim 10 wherein the heating means includes a resistive layer for heating at least a portion of the matrix.

13. Apparatus for forming a color image, comprising:

a) storage means for storing a digitized image;

b) a color display comprising:

i) a substrate;

ii) a matrix formed over the substrate;

iii) at least two different thermomeltable materials disposed in the matrix, each having a transition temperature range above room temperature wherein the viscosity of the thermomeltable material decreases substantially from below to above the transition temperature range;

iv) at least two different colored field-driven particles, each immersed in a particular one of the different thermomeltable materials, so that a particular color field-driven particle changes color reflective densities in response to an applied electric field when the material is above the transition temperature range and is stable at temperatures below its transition temperature range;

v) an array electrodes disposed above the substrate forming pairs of electrodes with each pair intersecting at a pixel for selectively applying an electric field in opposite directions across the matrix to drive the colored field-driven particles; and vi) heating means disposed in the display associated with the matrix for controlling the temperature of at least a portion of the matrix to control the response of the colored field-driven particles in the matrix; and c) electronic control means coupled to the heater means and the electrode array and responsive to the stored image for causing the heater means for selectively control the temperature of the matrix so that when the control means applies an electric field to the colored field-driven particles, they produce the color image.

14. The apparatus of claim 13 wherein the thermomeltable material is selected from the group consisting of wax, hydrocarbon polymers, or copolymers of alpha olefin and maleic anhydride.

15. The apparatus of claim 13 wherein the field-driven particles include electrophoretic particles or dipolar bi-chromatic particles.

16. The apparatus of claim 13 wherein the heating means includes a resistive layer for heating at least a portion of the matrix.

* * * * *